US010037697B2

(12) United States Patent
Kuraoka

(10) Patent No.: US 10,037,697 B2
(45) Date of Patent: Jul. 31, 2018

(54) DRIVING ASSISTANCE SYSTEM AND VEHICLE-MOUNTED DEVICE

(71) Applicant: DENSO CORPORATION, Kariya, Aichi-pref. (JP)

(72) Inventor: Hiroaki Kuraoka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/566,558

(22) PCT Filed: Mar. 25, 2016

(86) PCT No.: PCT/JP2016/001753
§ 371 (c)(1),
(2) Date: Oct. 13, 2017

(87) PCT Pub. No.: WO2016/166940
PCT Pub. Date: Oct. 20, 2016

(65) Prior Publication Data

US 2018/0090004 A1 Mar. 29, 2018

(30) Foreign Application Priority Data

Apr. 17, 2015 (JP) ..... 2015-085312

(51) Int. Cl.
*G08G 1/00* (2006.01)
*G08G 1/16* (2006.01)
(Continued)

(52) U.S. Cl.
CPC ..... *G08G 1/161* (2013.01); *G08G 1/017* (2013.01)

(58) Field of Classification Search
CPC .... G08G 1/161; G08G 1/017; H04L 43/0888; H04L 67/12; H04W 8/08; H04W 4/08; H04W 4/027
(Continued)

(56) References Cited

U.S. PATENT DOCUMENTS

2004/0157549 A1* 8/2004 Dold ..... H04L 45/00 455/7
2010/0188265 A1* 7/2010 Hill ..... G08G 1/0112 340/905
(Continued)

FOREIGN PATENT DOCUMENTS

JP 2002048684 A 2/2002
JP 2004246701 A 9/2004
JP 4752464 B2 8/2011

*Primary Examiner* — Jack K Wang
(74) *Attorney, Agent, or Firm* — Harness, Dickey & Pierce, P.L.C.

(57) ABSTRACT

The present disclosure provides a driving assistance system and a vehicle-mounted device. Each vehicle-mounted device broadcasts own vehicle information, and transmits wide area vehicle information to a center. The wide area vehicle information includes the vehicle information and VIN of the own vehicle. The center receives the wide area vehicle information, and stores the vehicle information and the VIN in a correlated manner in a center end database. The vehicle-mounted device transmits an appearance information request signal to the center. The appearance information request signal includes generation time and location information of a different vehicle. The center specifies, based on the generation time and the location information included in the appearance information request signal, the VIN of the vehicle requested by the vehicle-mounted device, and acquires the appearance information related to the specified
(Continued)

VIN by searching the appearance information database, and then transmits the appearance information to the vehicle-mounted device.

7 Claims, 4 Drawing Sheets

(51) Int. Cl.
*G08G 1/017* (2006.01)
*G08G 1/09* (2006.01)

(58) Field of Classification Search
USPC ..... 340/902, 905
See application file for complete search history.

(56) References Cited

U.S. PATENT DOCUMENTS

2013/0155083 A1* 6/2013 McKenzie ..... G06T 1/20 345/522
2013/0279491 A1* 10/2013 Rubin ..... G08G 1/166 370/347
2014/0063064 A1* 3/2014 Seo ..... G08G 1/166 345/633
2014/0195138 A1* 7/2014 Stelzig ..... G08G 1/0116 701/119
2014/0302774 A1* 10/2014 Burke ..... H04H 20/57 455/3.05
2015/0116100 A1* 4/2015 Yang ..... G07C 9/00119 340/426.19
2015/0353008 A1* 12/2015 Kline ..... B60W 40/04 340/993
2016/0080235 A1* 3/2016 Tan ..... H04L 43/0888 370/235
2016/0174106 A1* 6/2016 Lee ..... H04W 40/20 705/14.63
2016/0203374 A1* 7/2016 Zeng ..... G01S 13/726 382/104
2016/0212596 A1* 7/2016 Brahmi ..... H04L 67/12
2016/0280132 A1* 9/2016 Palanimuthu ..... B60Q 9/008
2017/0032402 A1* 2/2017 Patsiokas ..... G06Q 30/0266
2018/0090004 A1* 3/2018 Kuraoka ..... G08G 1/161

* cited by examiner

| VIN | VEHICLE TYPE | SIZE | COLOR |
|---|---|---|---|
| X | A | S | BLUE |
| Y | B | M | RED |
| Z | C | L | WHITE |
| ... | ... | ... | ... |

FIG. 5

<NEARBY VEHICLE LIST>

| VEHICLE ID | RECEPTION HISTORY STORAGE REGION | VEHICLE APPEARANCE INFO STORAGE REGION |
|---|---|---|
| IDxa | RECEPTION HISTORY DATA | VEHICLE TYPE=A, SIZE=S, COLOR=BLUE |
| IDya | RECEPTION HISTORY DATA | ... |
| IDza | RECEPTION HISTORY DATA | ... |

RECEPTION HISTORY DATA OF VEHICLE ID = IDxa

| GENERATION TIME | LOCATION INFO | VEHICLE SPEED | ACCELER-ATION | TRAVELING DIRECTION |
|---|---|---|---|---|
| T1a | (Nx1, Ex1) | Vx1 | Ax1 | θx1 |
| T2a | (Nx2, Ex2) | Vx2 | Ax2 | θx2 |
| T3a | (Nx3, Ex3) | Vx3 | Ax3 | θx3 |

FIG. 6

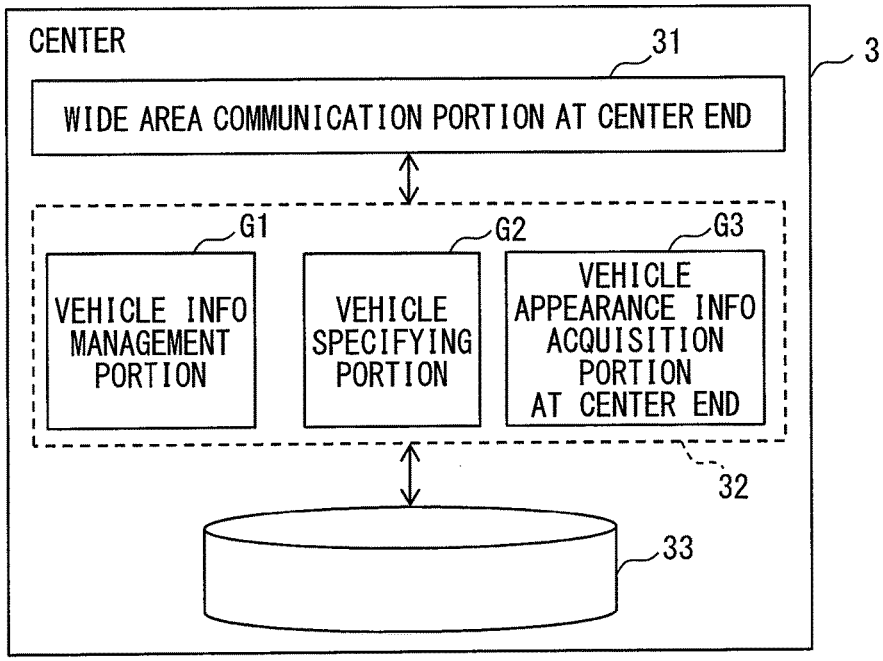

| VIN | TIME | LOCATION | SPEED | TRAVELING DIRECTION | VEHICLE ID |
|---|---|---|---|---|---|
| X | T1a | (Nx1, Ex1) | Vx1 | θx1 | IDxa |
| Y | T1b | (Ny1, Ey1) | Vy1 | θy1 | IDya |
| Z | T1c | (Nz1, Ez1) | Vz1 | θz1 | IDza |
| ... | ... | ... | ... | | |

DRIVING ASSISTANCE SYSTEM AND VEHICLE-MOUNTED DEVICE

CROSS REFERENCE TO RELATED APPLICATIONS

This application is a U.S. National Phase Application under 35 U.S.C. 371 of International Application No. PCT/JP2016/001753 filed on Mar. 25, 2016 and published in Japanese as WO 2016/166940 A1 on Oct. 20, 2016. This application is based on and claims the benefit of priority from Japanese Patent Application No. 2015-085312 filed on Apr. 17, 2015. The entire disclosures of all of the above applications are incorporated herein by reference.

TECHNICAL FIELD

The present disclosure relates to a driving assistance system assisting a driver for a driving operation according to information acquired through a vehicle-to-vehicle communication, and the present disclosure also relates to a vehicle-mounted device.

BACKGROUND ART

A vehicle-to-vehicle communication system has been proposed recently, in which any one of multiple vehicles transmits vehicle information, such as a traveling speed, a present location, and a traveling direction, of an own vehicle to different vehicles and successively receives vehicle information transmitted from the different vehicles. As a device used in such a vehicle-to-vehicle communication system, a vehicle-mounted device assists a driver for a driving operation according to the vehicle information of the different vehicles acquired through a vehicle-to-vehicle communication and the vehicle information of the own vehicle.

For example, Patent Literature 1 discloses a technique of determining whether an own vehicle and any different vehicle are likely to have an accidental contact according to the vehicle information of the vehicle in question and the vehicle information of the own vehicle and warning a driver to avoid an accidental contact when a likelihood of such an accidental contact is determined.

According to the disclosed technique, the driver can recognize presence of a vehicle traveling in a crossing direction when the driver is nearing an intersection with poor visibility.

PRIOR ART LITERATURE

Patent Literature

Patent Literature 1: JP 4752464 B

SUMMARY OF INVENTION

According to the related art represented by the technique disclosed in Patent Literature 1, the vehicle-mounted device is capable of notifying the driver of presence of any different vehicle near the own vehicle, for example, any different vehicle requiring attention of the driver when passing through an intersection. However, information exchanged through a vehicle-to-vehicle communication does not include information indicating a vehicle appearance of the different vehicle, such as a body color. The vehicle-mounted device is thus incapable of providing the driver with vehicle appearance information of the vehicle in question.

That is, according to the technique in the related art, the information provided from the vehicle-mounted device enables the driver to recognize the presence of any different vehicle requiring attention of the driver and a relative location of the vehicle in question. However, the driver has no idea what the attention requiring vehicle looks like in vehicle appearance. Hence, when a vehicle considered as the attention requiring vehicle notified by the vehicle-mounted device comes into the driver's field of sight, the driver may have difficulty in determining whether the vehicle the driver is seeing is really the attention requiring vehicle notified by the vehicle-mounted device.

In view of the foregoing difficulties, it is an object of the present disclosure to provide a driving assistance system and a vehicle-mounted device which make it easier for a driver to recognize a correspondence relationship between a vehicle coming into a driver's field of sight and a vehicle notified by a vehicle-mounted device.

According to an example of the present disclosure, a driving assistance system includes: a first vehicle-mounted device used in a first vehicle and furnished with a function of performing a vehicle-to-vehicle communication; a plurality of second vehicle-mounted devices respectively used in a plurality of second vehicles, each of the plurality of second vehicle-mounted devices being furnished with a function of performing the vehicle-to-vehicle communication; a center configured to perform a wide area communication individually with the first vehicle-mounted device or each of the plurality of second vehicle-mounted devices; and a vehicle appearance information storage portion storing a vehicle identification number assigned to each of the plurality of second vehicles and vehicle appearance information indicating a vehicle appearance of each of the plurality of second vehicles, the vehicle identification number being linked with the vehicle appearance of a same second vehicle. Each of the plurality of second vehicle-mounted devices includes: a transmission processing portion broadcasting, through the vehicle-to-vehicle communication, vehicle information including various types of information indicating a traveling state of an own vehicle, the own vehicle being one of the plurality of second vehicles that use the plurality of second vehicle-mounted devices; and a transfer processing portion transmitting, to the center, wide area vehicle information that includes a vehicle identification number assigned to the own vehicle and specifying information of the own vehicle, the specifying information being a part or whole of the vehicle information transmitted from the transmission processing portion. The specifying information is information having a sufficiently low likelihood that contents of respective specifying information of the plurality of second vehicles overlap with one another. The center includes a storage portion that links the vehicle identification number with the specifying information included in the wide area vehicle information and stores the vehicle identification number and the specifying information, the wide area vehicle information is transmitted from each of the plurality of second vehicle-mounted devices and received by the center. The first vehicle-mounted device includes: a different vehicle information acquisition portion acquiring the vehicle information broadcasted from each of the plurality of second vehicle-mounted devices through the vehicle-to-vehicle communication; a notification processing portion notifying a driver in the first vehicle of information on a transmitter vehicle which is one of the plurality of second vehicles as a transmitter of the vehicle information acquired by the different vehicle information acquisition portion; and a vehicle appearance information request portion transmitting a vehicle appearance information request signal to the center, the vehicle appearance information request signal including the specifying information acquired from the vehicle information of the transmitter vehicle and requesting the center to transmit vehicle appearance information of the transmitter vehicle corresponding to the vehicle information. The center further includes: a transmitter vehicle specifying portion specifying a vehicle identification number assigned to the transmitter vehicle upon receipt of the vehicle appearance information request signal transmitted from the first vehicle-mounted device, the transmitter vehicle specifying portion searching the storage portion of the center for the specifying information which matches with the specifying information included in the vehicle appearance information request signal; and a vehicle appearance information acquisition portion retrieving vehicle appearance information linked with the vehicle identification number specified by the transmitter vehicle specifying portion from the vehicle appearance information storage portion. The center transmits the vehicle appearance information retrieved by the vehicle appearance information acquisition portion of the center to the first vehicle-mounted device. The first vehicle-mounted device further includes a vehicle appearance information acquisition portion acquiring the vehicle appearance information transmitted from the center. The notification processing portion notifies the driver in the first vehicle of a presence of the transmitter vehicle in a manner that the driver is able to recognize a vehicle appearance of the transmitter vehicle using the vehicle appearance information acquired by the vehicle appearance information acquisition portion of the first vehicle-mounted device.

According to the configuration as above, each second vehicle-mounted device broadcasts the vehicle information of the own vehicle through a vehicle-to-vehicle communication, and transmits data including the specifying information and the preliminarily-assigned vehicle identification number, both of which are included in the broadcasted vehicle information, to the center. When the data transmitted from the second vehicle-mounted device is received at the center end, the specifying information and the vehicle identification number included in the received data are linked with each other and saved in the storage portion at the center end.

The specifying information transmitted from each second vehicle-mounted device is a type of information having a sufficiently low likelihood that an indicated state overlaps a state indicated by the specifying information of any other second vehicle. Hence, multiple pieces of the specifying information stored in the storage portion at the center end show states different from one another.

At the end of the first vehicle-mounted device, the different vehicle information acquisition portion acquires the vehicle information broadcasted from any second vehicle-mounted device present near the first vehicle. The vehicle appearance information request portion of the first vehicle-mounted device includes the acquired specifying information in the vehicle information of the second vehicle, which is acquired by the different vehicle information acquisition portion, in a vehicle appearance information request signal, and transmits the vehicle appearance information request signal to the center.

When the vehicle appearance information request signal transmitted from the first vehicle is received at the end of the center, the vehicle identification number of a transmitter vehicle of the vehicle information received by the first vehicle-mounted device is specified based on the specifying information included in the received vehicle appearance information request signal. Vehicle appearance information linked with the specified vehicle identification number is retrieved from the vehicle appearance information storage portion, and returned to the first vehicle-mounted device.

According to the configuration as above, the first vehicle-mounted device is capable of acquiring vehicle appearance information of the second vehicle functioning as a transmitter according to the vehicle information acquired through a vehicle-to-vehicle communication. The notification processing portion notifies the driver of the second vehicle in question in a manner that the driver is able to recognize what the second vehicle in question looks like in vehicle appearance.

That is, according to the configuration as above, the driver is enabled to recognize what a vehicle notified by the notification processing portion looks like in vehicle appearance. Hence, when the driver actually finds a vehicle considered as the vehicle notified by the notification processing portion within sight of the driver, the driver can readily determine whether the visually confirmed vehicle is the notified vehicle by comparing a vehicle appearance of the vehicle the driver is actually seeing with the vehicle appearance information notified by the notification processing portion. In other words, according to the configuration as above, the driver can readily find a correspondence relation between a vehicle coming into sight of the driver and a vehicle notified by the notification processing portion.

According to an example of the present disclosure, a vehicle-mounted device includes: a wide area communication portion performing a wide area communication with a center disposed outside of an own vehicle; a transmission processing portion broadcasting vehicle information including various types of information indicating a traveling state of the own vehicle through a vehicle-to-vehicle communication; a transfer processing portion transmitting wide area vehicle information to the center, the wide area vehicle information including specifying information that is predetermined type of information and a vehicle identification number that is a number preliminarily assigned to the own vehicle, the specifying information and the vehicle identification number are a part of the vehicle information transmitted from the transmission processing portion; a different vehicle information acquisition portion acquiring different vehicle information broadcasted from a different vehicle through the vehicle-to-vehicle communication; a notification processing portion notifying a driver in the own vehicle of information on a transmitter vehicle that is the different vehicle in response to an acquisition of the vehicle information by the different vehicle information acquisition portion; a vehicle appearance information request portion transmitting a vehicle appearance information request signal to the center, the vehicle appearance information request signal including specifying information included in the different vehicle information transmitted from the transmitter vehicle and requesting the center to provide vehicle appearance information indicating a vehicle appearance of the transmitter vehicle; and a vehicle appearance information acquisition portion acquiring the vehicle appearance information of the transmitter vehicle, the center transmitting the vehicle appearance information of the transmitter vehicle in response to the vehicle appearance information request signal transmitted from the vehicle appearance information request portion. The notification processing portion notifies the driver in the own vehicle of a presence of the different vehicle in a manner that the driver is able to recognize the vehicle appearance information of the different vehicle.

The vehicle-mounted device configured as above is a vehicle-mounted device furnished with functions of both of the first vehicle-mounted device and the second vehicle-mounted devices in the driving assistance system described above. Hence, the driving assistance system described above can be realized by using the vehicle-mounted device configured as above in each individual vehicle.

BRIEF DESCRIPTION OF DRAWINGS

The above and other objects, features and advantages of the present invention will become more apparent from the following detailed description made with reference to the accompanying drawings. In the drawings:

FIG. 5 is a view used to describe an example of a format of a nearby vehicle list stored in a memory;

FIG. 6 is a block diagram showing an example of a schematic configuration of a center;

EMBODIMENTS FOR CARRYING OUT INVENTION (Embodiments)

Figures 1, 2:
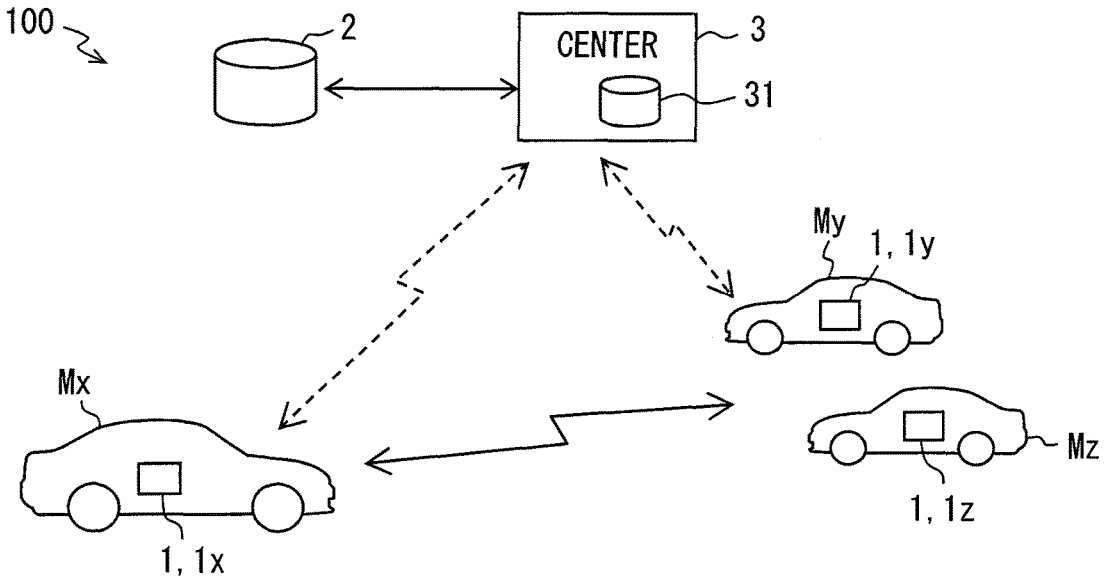
FIG. 1 is a block diagram showing a schematic configuration of a driving assistance system according to an embodiment.
FIG. 2 is a view showing an example of a format of data stored in a vehicle appearance information DB.

Hereinafter, an embodiment will be described using the drawings. FIG. 1 is a view showing an example of a schematic configuration of a driving assistance system 100 of the present embodiment. The driving assistance system 100 includes multiple vehicle-mounted devices 1 used in multiple vehicles Mx, My, and Mz, one in each vehicle, a vehicle database (hereinafter, referred to as a vehicle appearance information DB) 2 where vehicle appearance information described below is stored vehicle by vehicle, and a center 3 provided outside of the respective vehicles and connected to a wide area communication network.

The vehicle-mounted device 1 mounted to each vehicle communicates with the center 3 via the wide area communication network. The center 3 is allowed to access the vehicle appearance information DB 2 via the wide area communication network or a LAN (Local Area Network). The wide area communication network referred to herein means a public communication network provided by a telecommunication corporation, such as a mobile telephone network and the Internet.

The vehicle-mounted device 1 mounted to each vehicle also wirelessly communicates with any different vehicle-mounted device 1 present near an own terminal through radio waves in a preliminarily allocated frequency band without using the wide area communication network (performs so-called a vehicle-to-vehicle communication). A frequency band used in a vehicle-to-vehicle communication is, for example, a radio wave in a 700 MHz band, a 5.8 to 5.9 GHz band, or a 2.4 GHz. The phrase, "near the own terminal", referred to herein means a range within which a vehicle-to-vehicle communication is available. An available range of a vehicle-to-vehicle communication may be designed as needed and a range designed often is within tens to hundreds of meters.

For each vehicle-mounted device 1, a vehicle equipped with the vehicle-mounted device 1 corresponds to an own vehicle and a vehicle present near the own vehicle and equipped with any different vehicle-mounted device 1 as a party of a vehicle-to-vehicle communication being made corresponds to a nearby vehicle. When the vehicle-mounted devices 1 mounted to the respective vehicles Mx, My, and Mz are distinguished from one another, the vehicle-mounted device 1 mounted to the vehicle Mx is labeled with 1*x*, the vehicle-mounted device 1 mounted to the vehicle My is labeled with 1*y*, and the vehicle-mounted device 1 mounted to the vehicle Mz is labeled with 1*z*.

For example, given that the vehicle Mx corresponds to a first vehicle and the vehicles My and Mz correspond to second vehicles. Then, the vehicle-mounted device 1*x* corresponds to a first vehicle-mounted device and the vehicle-mounted devices 1*y* and 1*z* correspond to second vehicle-mounted devices.

Each vehicle-mounted device 1 is dynamically assigned with a vehicle ID (corresponding to identification information) to identify itself and any different vehicle-mounted device 1 as communication parties of a vehicle-to-vehicle communication. A communication packet transmitted from each vehicle-mounted device 1 through a vehicle-to-vehicle communication includes the vehicle ID of a transmitter terminal to enable any vehicle-mounted device 1 which has received the data (that is, a receiver terminal) to specify the transmitter terminal by the vehicle ID included in the data. It should be noted that the vehicle IDs used in a vehicle-to-vehicle communication are different from a vehicle identification number described below.

The following will describe schematic configurations of respective components forming the driving assistance system 100 in order of the vehicle appearance information DB 2, the vehicle-mounted device 1, and the center 3 for ease of description.

(Vehicle Appearance Information DB 2)

The vehicle appearance information DB 2 is a database, in which vehicle identification numbers (VINs) assigned to the respective vehicles used in the driving assistance system 100 and vehicle appearance information indicating vehicle appearances of the respective vehicles are linked with each other and stored as data. The vehicle appearance information DB 2 corresponds to a vehicle appearance information storage portion.

The vehicle appearance information referred to herein corresponds to vehicle type information indicating a vehicle type, size information indicating a size, color information indicating a body base color, and so on. A VIN is a fixed string of characters including an international manufacturer identifier identifying a manufacturer, a VDS (Vehicle Descriptor Section) specifying a vehicle model, and so on.

The vehicle type information indicates a type of a body shape of a vehicle (so-called a body type), such as a SUV (Sport Utility Vehicle), a sports type, a sedan type, a wagon type, and a hatchback type. Alternatively, the vehicle type information may be information indicating types defined by a purpose, a size, a weight, a maximum load, a riding capacity, and so on, such as an ordinary vehicle, a compact vehicle, a mini four-wheeled vehicle, a bus, and a special purpose vehicle.

The size information may be expressed by multiple classifications preliminarily set according to sizes of vehicles (small size, medium size, large size, and so on). The small size is a classified size for relatively small vehicles, such as small automobiles. The medium size is a classified size for vehicles of a standard size, such as ordinary automobiles. The large size is a classified size for relatively large vehicles, such as a bus and a truck. The classified small, medium, and large sizes may be defined as needed by a vehicle width, a vehicle length, a weight, and so on. Alternatively, the size information may be data designating a vehicle width and a vehicle length concretely.

FIG. 2 is a conceptual view showing a format of data stored in the vehicle appearance information DB 2. As is shown in FIG. 2, VINs linked with a vehicle type, a size, and a color are stored vehicle by vehicle. More specifically, the data shows that in the case of a vehicle assigned with a VIN exhibiting X, a vehicle type is A (for example, hatchback type), a size is small, and a base color is blue. The data also shows that in the case of a vehicle assigned with a VIN exhibiting Y, a vehicle type is B (for example, sedan type), a size is medium, and a base color is red, and in the case of a vehicle assigned with a VIN exhibiting Z, a vehicle type is C (for example, pickup truck type), a size is large, and a base color is white.

The vehicle appearance information DB 2 is managed (data is added and updated) by, for example, vehicle manufacturers or dealers, or vehicle safety inspection agents. The vehicle appearance information DB 2 is accessible by the center 3 and provides vehicle appearance information of a vehicle assigned with a VIN designated by the center 3.

(Configuration of Vehicle-Mounted Device 1)

Each vehicle-mounted device 1 is incorporated into a vehicle which uses the vehicle-mounted device 1 (that is, the own vehicle), and makes a vehicle-to-vehicle communication with any other nearby vehicle-mounted device 1 and a data communication with the center 3 via the wide area communication network. The present embodiment will describe an example where the vehicle-mounted device 1 is incorporated into the own vehicle. However, it may be configured in such a manner that the vehicle-mounted device 1 is portable and attached to and removed from a holder provided to the own vehicle by a user.

Figure 3:
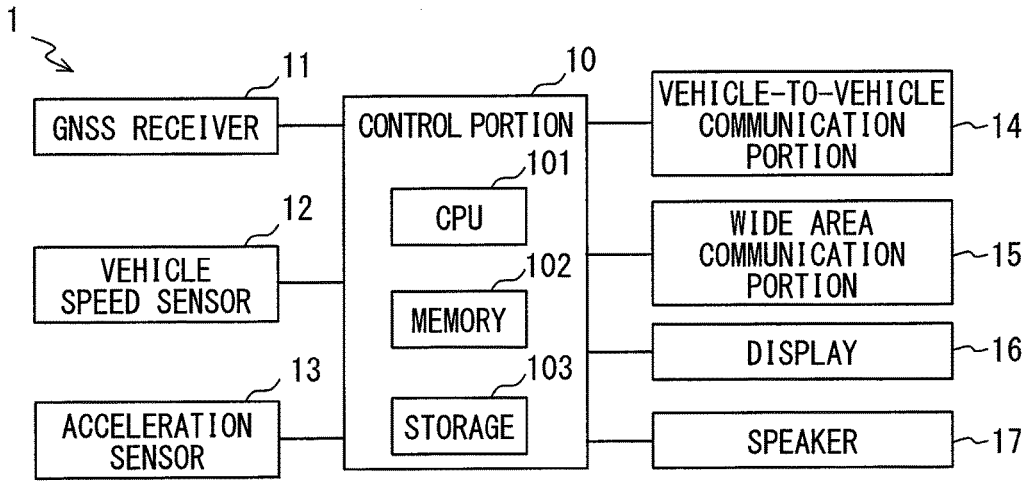
FIG. 3 is a block diagram showing an example of a schematic configuration of a vehicle-mounted device.

FIG. 3 shows a schematic configuration of the vehicle-mounted device 1. As is shown in FIG. 3, the vehicle-mounted device 1 includes a control portion 10, a GNSS receiver 11, a vehicle speed sensor 12, an acceleration sensor 13, a vehicle-to-vehicle communication portion 14, a wide area communication portion 15, a display 16, and a speaker 17. The control portion 10 is connected individually to the GNSS receiver 11, the vehicle-speed sensor 12, the acceleration sensor 13, the vehicle-to-vehicle communication portion 14, the wide area communication portion 15, the display 16, and the speaker 17, and is capable of making a two-way communication with each connected component.

The GNSS receiver 11 acquires information indicating a present location of the GNSS receiver 11 by receiving a radio wave from a satellite (GNSS satellite) used in a GNSS (Global Navigation Satellite System). The present location obtained by the GNSS receiver 11 may be shown by, for example, latitude and longitude designation. Location information acquired by the GNSS receiver 11 is successively (for example, every 100 milliseconds) provided to the control portion 10. The vehicle speed sensor 12 is a sensor detecting a traveling speed of the vehicle (that is, a vehicle speed), and the acceleration sensor 13 is a sensor detecting acceleration acting in a front-rear direction of the vehicle.

The vehicle-to-vehicle communication portion 14 includes an antenna capable of transmitting and receiving a radio wave in a frequency band used for a vehicle-to-vehicle communication, and makes a wireless communication with any different vehicle-mounted device 1 present near the own terminal. More specifically, the vehicle-to-vehicle communication portion 14 outputs a signal to the control portion 10 by demodulating a signal received at the antenna and transmits a radio wave by modulating and converting data inputted from the control portion 10.

The wide area communication portion 15 is connected to the wide area communication network, and provides a signal to the control portion 10 by demodulating a signal received via the wide area communication network and transmits a signal to the center 3 by modulating a baseband signal inputted from the control portion 10. In short, the wide area communication portion 15 exchanges data with the center 3. The display 16 displays an image (including a text) corresponding to a control signal inputted from the control portion 10. The display 16 may be realized by a liquid crystal display or an organic EL display. Alternatively, a known head-up display may be adopted as the display 16. The speaker 17 outputs a sound signal inputted from the control portion 10 as a sound.

The control portion 10 is formed as a normal computer, and includes a CPU 101, a memory 102, a storage 103, I/O, and a bus line interconnecting the foregoing components. The memory 102 may be realized by a temporary recording medium, for example a RAM, and functions as a primary storage device for the CPU 101.

The storage 103 may be realized by a non-volatile recording medium, such as a ROM and a flash memory, and functions as a secondary storage device for the CPU 101. In the storage 103, software and data to perform various types of processing, VINs assigned to vehicles equipped with the vehicle-mounted devices 1, vehicle ID's to identify terminals in a vehicle-to-vehicle communication, and so on are stored.

Figure 4:
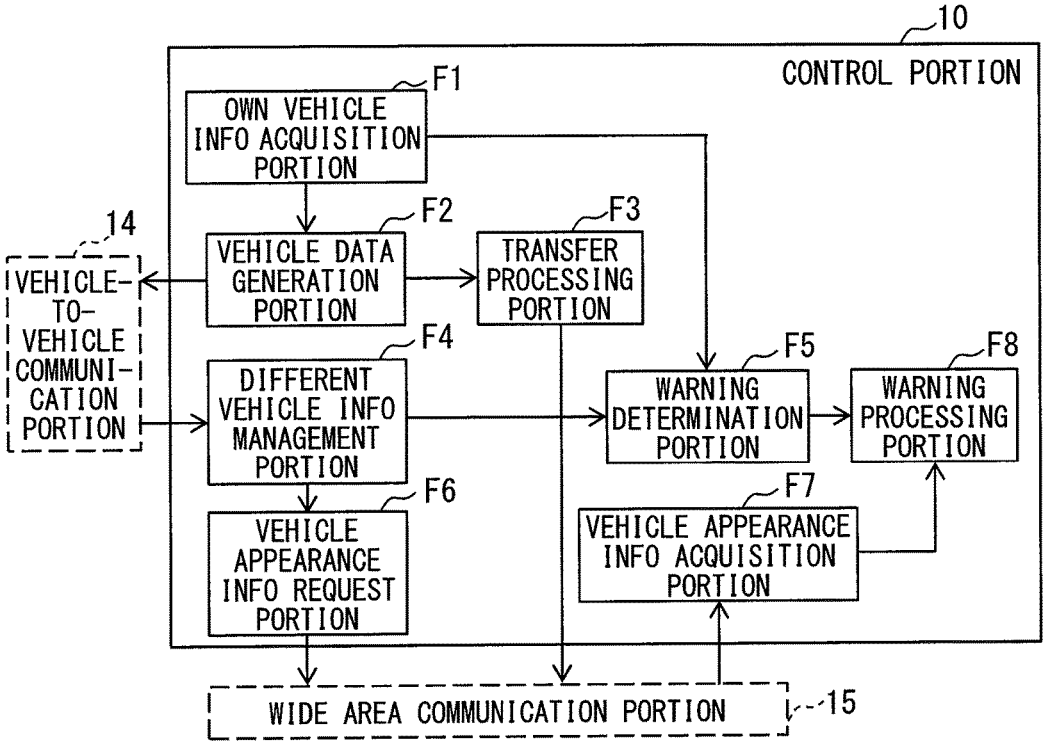
FIG. 4 is a block diagram showing a schematic configuration of a control portion provided to the vehicle-mounted device.

As is shown in FIG. 4, the control portion 10 includes, as functional blocks realized by the software, an own vehicle information acquisition portion F1, a vehicle data generation portion F2, a transfer processing portion F3, a different vehicle information management portion F4, a warning determination portion F5, a vehicle appearance information request portion F6, a vehicle appearance information acquisition portion F7, and a warning processing portion F8. The functions furnished to the control portion 10, either partially or entirely, may be formed by hardware, such as a single or more than one IC.

The own vehicle information acquisition portion F1 acquires various types of information (own vehicle information) on traveling of a vehicle equipped with the vehicle-mounted device 1 in question (that is, own vehicle) from sensors or the like connected to the control portion 10, such as the GNSS receiver 11 and the vehicle speed sensor 12. The own vehicle information includes a present location, a vehicle speed, acceleration, and a traveling direction of the own vehicle, time information, and so on. The traveling direction may be determined according to a detection result of a geomagnetic sensor which detects an orientation of the vehicle or may be specified by tracking a present location inputted from the GNSS receiver 11. The traveling direction may be indicated by an angle with respect to a reference (0 degree) set in, for example, a north direction.

Information included in the own vehicle information is not limited to the types of information specified above. For example, information on whether a brake pedal is depressed, information on whether a direction indicator is turned on, information on at which position a gear is shifted may also be included in the own vehicle information. The own vehicle information acquisition portion F1 corresponds to a first vehicle information acquisition portion and the own vehicle information corresponds to first vehicle information.

The own vehicle information acquired by the own vehicle information acquisition portion F1 may be held in the memory 102 until a certain time (for example, five seconds) elapses after acquisition and discarded successively. The own vehicle information is acquired successively and may be arranged in time series in the memory 102 with latest information at a head.

The vehicle data generation portion F2 generates data indicating a traveling state of the own vehicle (vehicle data) according to the own vehicle information acquired by the own vehicle information acquisition portion F1 as data to be transmitted to a nearby vehicle through a vehicle-to-vehicle communication. For example, the vehicle data includes the vehicle ID, a present location of the data, a vehicle speed, acceleration, and a traveling direction of the own vehicle, and a present time as a generation time of the data. It should be appreciated that the vehicle data may include information other than the information specified above. For example, the vehicle data may also include information on a traveling direction, information on a set gear shift position, information on an ON or OFF state of a brake light, and information on a state of a direction indicator switch. The generation time corresponds to a time when the data is transmitted (that is, transmission time). The vehicle data may be generated in accordance with a data format adopted by vehicle-to-vehicle communication standards.

The vehicle data generation portion F2 generates the vehicle data in predetermined transmission cycles (for example, every 100 milliseconds) and outputs the vehicle data to the vehicle-to-vehicle communication portion 14. Upon input of the vehicle data from the vehicle data generation portion F2, the vehicle-to-vehicle communication portion 14 broadcasts the vehicle data to nearby vehicles. Hence, the vehicle data generation portion F2 corresponds to a transmission processing portion. The vehicle data generation portion F2 provides the transfer processing portion F3 with data same as the vehicle data outputted to the vehicle-to-vehicle communication portion 14.

The transfer processing portion F3 generates data (wide area vehicle data) by appending the VIN assigned to the own vehicle to the vehicle data generated in the vehicle data generation portion F2, and outputs the wide area vehicle data to the wide area communication portion 15. Upon input of the wide area vehicle data from the transfer processing portion F3, the wide area communication portion 15 transmits the wide area vehicle data to the center 3. That is, the transfer processing portion F3 performs processing to upload information including a same content as the own vehicle information broadcasted to nearby vehicles through a vehicle-to-vehicle communication to the center 3. The transfer processing portion F3 may generate the wide area vehicle data at a frequency of, for example, once in every second or every few seconds. That is, given that the vehicle data generation portion F2 generates the vehicle data every 100 milliseconds, then the transfer processing portion F3 may transmit the wide area vehicle data corresponding to latest vehicle data each time the vehicle data generation portion F2 generates the vehicle data ten to a few tens of times.

According to the configuration of the present embodiment, information including entire information broadcasted to nearby vehicles through a vehicle-to-vehicle communication is also transferred to the center 3. However, the present disclosure is not limited to the configuration as above. For example, the wide area data may be data generated by appending the VIN to the generation time and the location information included in the vehicle data.

Incidentally, it is quite rare that more than one vehicle is present in a same location at a same time. Hence, a state determined by a combination of the generation time and the location information included in the vehicle information belonging to a vehicle and a state determined by a combination of the generation time and the location information of the vehicle information belonging to a different vehicle have a sufficiently low likelihood of overlapping. That is, information made up of a combination of the location information and the generation time corresponds to specifying information. Also, the wide area vehicle data corresponds to wide area vehicle information.

The different vehicle information management portion F4 acquires vehicle data transmitted from any different vehicle present near the own vehicle and received at the vehicle-to-vehicle communication portion 14 as different vehicle information. The different vehicle information includes same types of information included in the vehicle data generated by the vehicle data generation portion F2. Herein, the different vehicle information includes the vehicle ID identifying a transmitter of the received different vehicle information, generation time of the data, a present location, a vehicle speed, and acceleration of the transmitter vehicle at the data generation time. Hence, the different vehicle information can be said as information indicating a traveling state of any different vehicle as a transmitter of the different vehicle information.

When the different vehicle information management portion F4 acquires the different vehicle information, the acquired different vehicle information is linked with the vehicle ID of the vehicle in question as the transmitter of the data and stored in the memory 102. In the manner as above, the different vehicle information management portion F4 manages information on any different vehicle present near the own vehicle for each vehicle ID (that is, vehicle by vehicle).

For example, the different vehicle information management portion F4 of the present embodiment manages the information on any different vehicle present near the own vehicle using a nearby vehicle list as is shown in FIG. 5, in which different vehicles present near the own vehicle are listed. The nearby vehicle list includes a reception history storage region where the vehicle information received from the different vehicles is stored and a vehicle appearance information storage region where vehicle appearance information of the different vehicles is stored for each vehicle ID.

Reception history data, which is data made up of the vehicle information received from the different vehicles and arranged in descending order of reception times, is stored in the reception history storage region. The reception history data indicates a generation time, location information, a vehicle speed, acceleration, and a traveling direction included in the vehicle information received at each time point. Data included in the different vehicle reception data may be discarded successively from oldest data. Data linked with a vehicle ID for which the vehicle information has not been received for a certain time is deleted from the nearby vehicle list. Vehicle appearance information acquired by the vehicle appearance information acquisition portion F7 described below is stored in the vehicle appearance information storage region. The different vehicle information management portion F4 corresponds to a different vehicle information acquisition portion.

The warning determination portion F5 specifies a locational relation with any different vehicle present near the own vehicle and a time-variation in locational relation according to the different vehicle information of the respective different vehicles stored in the memory 102 and the own vehicle information, and computes a likelihood of a collision between the own vehicle and each one of the different vehicles present near the own vehicle. When a vehicle (attention requiring vehicle) having a likelihood of a collision with the own vehicle as high as or higher than a predetermined threshold value is present among the different vehicles, the warning determination portion F5 determines that it is necessary to perform processing (warning processing) to call upon a driver to pay attention to the attention requiring vehicle. The attention requiring vehicle corresponds to a notified vehicle.

The warning determination portion F5 is configured to set any different vehicle having a likelihood of a collision as high as or higher than the predetermined threshold value as an attention requiring vehicle, and determines that it is necessary to perform the warning processing for the driver when the attention requiring vehicle is present. However, the present disclosure is not limited to the configuration as above. It may be configured in such a manner that the warning determination portion F5 calculates a time (TTC standing for Time to Collision) left until the attention requiring vehicle and the own vehicle are to collide and determines that it is necessary to perform the warning processing for the attention requiring vehicle when a TTC is equal to or less than a predetermined value. A method of computing a likelihood of a collision according to the vehicle information of the own vehicle and the vehicle information of the vehicle in question and a method of calculating a TTC are known and a detailed description is omitted herein.

Alternatively, it may be configured in such a manner that the warning determination portion F5 determines a necessity of the warning processing for all the different vehicles present near the own vehicle. In such a case, information on all the different vehicles present near the own vehicle is provided to the driver by the warning processing portion F8 described below.

The vehicle appearance information request portion F6 requests the center 3 to provide vehicle appearance information on any different vehicle making a vehicle-to-vehicle communication with the own vehicle. More specifically, when a vehicle-to-vehicle communication starts with any different vehicle whose vehicle appearance information has not been acquired, the vehicle appearance information request portion F6 transmits a vehicle appearance information request signal for the vehicle in question to the center 3 in cooperation with the wide area communication portion 15. The vehicle appearance information request signal may include, for example, a generation time and a present location included in the different vehicle information received from the vehicle in question. Time information included in the vehicle appearance information request signal may be a time (reception time) when the different vehicle information is received or a time (transmission time) when the different vehicle information is transmitted from the transmitter instead of the generation time included in the different vehicle information.

When the vehicle appearance information request signal is received at an end of the center 3, a VIN assigned to the vehicle present at a time and a location indicated, respectively, by the time information and the present location information included in the vehicle appearance information request signal is specified. The vehicle appearance information linked with the specified VIN is retrieved from the vehicle appearance information DB 2 and returned to the vehicle-mounted device 1.

According to the configuration described herein as an example, a vehicle appearance information request signal is transmitted for any different vehicle when a vehicle-to-vehicle communication is started with the vehicle in question for a first time. However, the present disclosure is not limited to the configuration as above. It may be configured in such a manner that when the warning determination portion F5 determines that any one of the different vehicles is likely to have an accidental contact with the own vehicle, a vehicle appearance information request signal is transmitted for the vehicle in question (that is, attention requiring vehicle).

Further, the vehicle appearance information request portion F6 may transmit a vehicle appearance information request signal according to newly received different vehicle information each time the different vehicle information management portion F4 receives different vehicle information. The configuration as above may be modified in such a manner that once vehicle appearance information is received for any different vehicle, a determination is made as to whether the different vehicle information received from the vehicle in question satisfies a predetermined condition (holding condition) and a vehicle appearance information request signal is transmitted for the vehicle in question again when the holding condition is no longer satisfied.

The holding condition may be a condition as follows. In a circumstance where a transmission interval AT of the vehicle information (to be more exact, the vehicle data) is 100 milliseconds, it is expected that a variance is small between a vehicle speed $V_1$ and location information ($N_1$, $E_1$) indicated by the vehicle information acquired from any different vehicle at an arbitrary time and a vehicle speed $V_2$ and location information ($N_2$, $E_2$) indicated by the different vehicle information acquired from the vehicle in question at a following time. Herein, $N_1$ and $N_2$ indicate the latitude and $E_1$ and $E_2$ indicate the longitude. Hence, the location information indicated by the different vehicle information acquired from the vehicle in question at a following time can be estimated in accordance with Equation (1) and Equation (2) as follows:

$$N_{21}=N_1+V_{1N}\times\Delta T \quad \text{Equation (1)}$$

$$E_{21}=E_1+V_{1E}\times\Delta T \quad \text{Equation (2)}$$

where $N_{21}$ is an estimation value of the latitude in the location information indicated by the different vehicle information acquired at a following time, $E_{21}$ is an estimation value of the longitude in the location information indicated by the different vehicle information acquired at the following time, $V_{1N}$ is a latitude direction component of a vehicle speed indicated by latest different vehicle information, and $V_{1E}$ is a longitudinal direction component of the vehicle speed indicated by the latest different vehicle information. Herein, $V_{1N}$ and $V_{1E}$ may be determined by a vehicle speed and a traveling direction.

A condition adopted as the holding condition may be a condition that a distance difference ΔD between the estimated location information ($N_{21}$, $E_{21}$) and the location information ($N_2$, $E_2$) indicated by the different vehicle information actually acquired at the following time from the vehicle in question is less than a predetermined threshold value. When configured in such a manner, a vehicle appearance information request signal is transmitted again for the vehicle in question in a case where a difference between the estimated location information and the location information indicated by the different vehicle information newly acquired from the vehicle in question is equal to or greater than the predetermined threshold value. In the following, any different vehicle whose vehicle appearance information is requested is referred to as a requested vehicle for ease of description.

The vehicle appearance information acquisition portion F7 acquires vehicle appearance information returned from the center 3 in response to the request from the vehicle appearance information request portion F6. The acquired vehicle appearance information is linked with the vehicle information of the vehicle in question as the vehicle appearance requested vehicle and saved in the memory 102. That is, in the present embodiment, the received vehicle appearance information is stored in the vehicle appearance information storage region of the vehicle in question in the nearby vehicle list. The vehicle appearance information acquisition portion F7 corresponds to a vehicle appearance information acquisition portion at a vehicle-mounted device end.

The warning processing portion F8 performs warning processing to notify the driver of the presence of the attention requiring vehicle, which is ground for the determination made by the warning determination portion F5 that it is necessary to perform the warning processing. For example, the warning processing portion F8 displays an image showing an icon image representing the own vehicle and an icon image representing the attention requiring vehicle superimposed on a map image of a map near the own vehicle on the display 16. It is preferable that a display position of the icon image of the own vehicle and a display position of the icon image of the attention requiring vehicle on the map image are mapped on locations in an actual locational relation.

In a case where the presence of the attention requiring vehicle is notified to the driver by displaying the icon image of the attention requiring vehicle on the display 16, the warning processing portion F8 uses an image resembling the vehicle appearance information of the attention requiring vehicle as the icon image of the attention requiring vehicle displayed on the display 16. In short, an icon image resembling the attention requiring vehicle in size, vehicle type, and base color is displayed. Hence, what the attention requiring vehicle looks like in vehicle appearance can be notified to the driver. The warning processing portion F8 may notify the driver of what the attention requiring vehicle looks like in vehicle appearance by a text instead of an icon image.

The warning processing portion F8 may warn the driver of the presence of the attention requiring vehicle by outputting a sound that reads a predetermined message from the speaker 17 in addition to the warning processing via the display 16. Even in such a case, the warning processing portion F8 also outputs a message providing the vehicle appearance information of the attention requiring vehicle. For example, in a circumstance where a red vehicle of a sedan type and a medium size is approaching as the attention requiring vehicle from a right side of an intersection the own vehicle is going to pass, a message that reads "a red sedan is approaching from your right" may be outputted. Even when the warning processing is performed by means of a sound as above, the driver can be notified of what the attention requiring vehicle looks like in vehicle appearance. The warning processing portion F8 corresponds to a notification processing portion.

(Center 3)

The center 3 is connected to the wide area communication network and capable of making a two-way communication with each vehicle-mounted device 1 included in the driving assistance system 100 via the wide area communication network. The center 3 may be realized by a single server device or multiple server devices worked in cooperation by a cloud computing technology.

As is shown in FIG. 6, the center 3 includes a wide area communication portion 31 at a center end, a control portion 32 at the center end, and a database 33 at the center end (hereinafter, referred to as a DB 33 at the center end). The wide area communication portion 31 at the center end is a device to perform a wide area communication. The control portion 32 at the center end is allowed to exchange data with the respective vehicle-mounted devices 1 and access the vehicle appearance information DB 2 via the wide area communication portion 31 at the center end. For example, the wide area communication portion 31 at the center end receives wide area vehicle data and a vehicle appearance information request signal transmitted from any vehicle-mounted device 1. Data received at the wide area communication portion 31 at the center end is provided to the control portion 32 at the center end.

The DB 33 at the center end is a database where various types of data are stored. The DB 33 at the center end may be realized by a rewritable storage medium with a relatively large storage capacity.

The control portion 32 at the center end controls an overall operation of the center 3. The control portion 32 at the center end may be realized by a normal computer. The control portion 32 at the center end includes functional blocks corresponding to various types of processing performed by the center 3, namely, a vehicle information management portion G1, a vehicle specifying portion G2, and a vehicle appearance information acquisition portion G3 at the center end. The functional blocks may be realized by software or hardware by means of a single or more than one IC or the like.

The vehicle information management portion G1 is a functional block which manages the wide area vehicle data transmitted from any vehicle-mounted device 1 and received at the wide area communication portion 31 at the center end. More specifically, when the wide area vehicle data transmitted from any vehicle-mounted device 1 is received at the wide area communication portion 31 at the center end, as is shown in FIG. 6, a VIN indicated by the received wide area vehicle data is linked with the vehicle information and saved in the DB 33 at the center end. Hence, the DB 33 at the center end corresponds to a storage portion at a center end. Data made up of a VIN and vehicle information linked with each other is referred to as VIN-vehicle information link data for ease of description.

A management method of the wide area vehicle data received at the center 3 from any vehicle-mounted device 1 may be designed as needed. For example, the wide area vehicle data transmitted from the multiple vehicle-mounted devices 1 at any time may be managed for each vehicle-mounted device 1 as a transmitter (VIN by VIN), and in a case where the wide area vehicle data is received more than once from a same vehicle-mounted device 1, vehicle state information at several time points may be held as the reception history data.

The vehicle specifying portion G2 specifies a VIN assigned to a vehicle corresponding to a vehicle appearance information request signal transmitted from any vehicle-mounted device 1 and received at the wide area communication portion 31 at the center end. The vehicle specifying portion G2 corresponds to a transmitter vehicle specifying portion.

More specifically, the vehicle specifying portion G2 searches for vehicle information matching search criteria, which are a generation time and location information indicated by the vehicle appearance information request signal received at the wide area communication portion 31 at the center end. The vehicle information matching the search criteria is vehicle information including a combination of a generation time and location information coinciding, respectively, with the generation time and the location information used as the search criteria. When the vehicle information matching the search criteria is found, the vehicle specifying portion G2 acquires a VIN (searched VIN) linked with the found vehicle information and provides the searched VIN to a vehicle appearance information providing portion at the center end.

When the searched VIN is provided from the vehicle specifying portion G2, the vehicle appearance information acquisition portion G3 at the center end accesses the vehicle appearance information DB 2, and retrieves vehicle appearance information linked with the searched VIN. The vehicle appearance information acquisition portion G3 at the center end operates in cooperation with the wide area communication portion 31 at the center end and returns the retrieved vehicle appearance information to the vehicle-mounted device 1 as the transmitter of the vehicle appearance information request signal.

For example, when a vehicle appearance information request signal including the generation time exhibiting T1*b* and the location information exhibiting Ny1 and Ey1 as the search criteria is received at the end of the center 3, the vehicle appearance information acquisition portion G3 at the center end accesses the VIN-vehicle information link data stored in the DB 33 at the center end and searches for data made up of the generation time exhibiting T1*b* and the location information exhibiting Ny1 and Ey1.

Figures 7, 8:
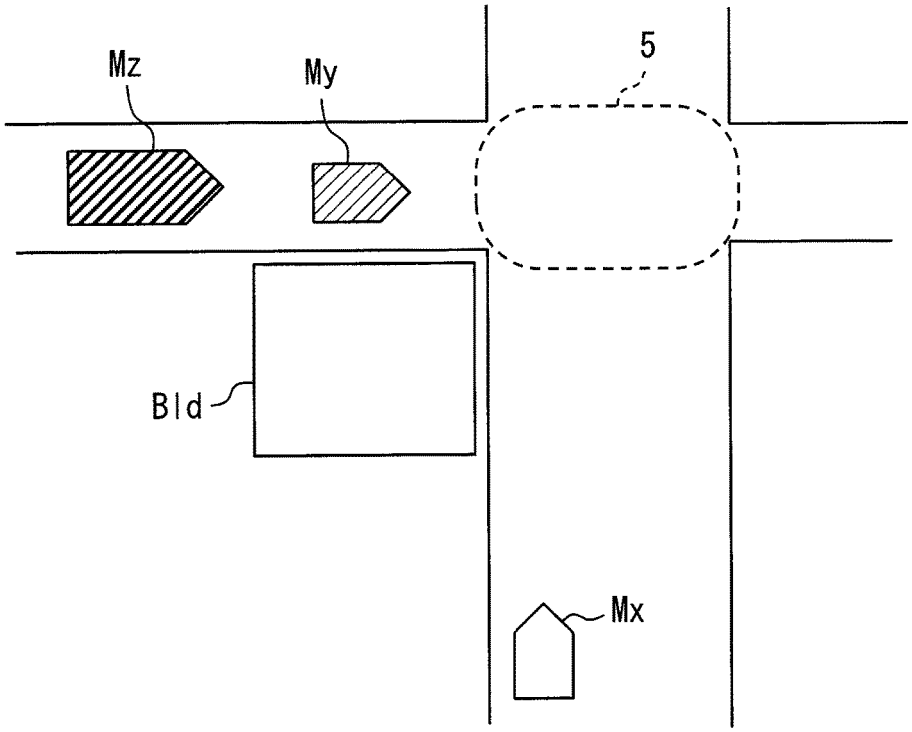
FIG. 7 is a view showing an example of a format of data stored in a DB at an end of the center.
FIG. 8 is a conceptual view used to describe an operation and an effect of the embodiment.

In an example shown in FIG. 7, data of a vehicle assigned with a VIN exhibiting Y hits as the data made up of the generation time exhibiting T1*b* and the location information exhibiting Ny1 and Ey1. Hence, the center 3 accesses the vehicle appearance information DB 2 and retrieves vehicle appearance information (vehicle type=B, size=M, and base color=red) of the vehicle assigned with the VIN exhibiting Y. The center 3 returns the retrieved vehicle appearance information to the vehicle-mounted device 1 as the transmitter of the vehicle appearance information request signal. The retrieved vehicle appearance information may be linked with the VIN and saved in the DB 33 at the center end. According to the configuration as above, a task of extracting (searching and retrieving) the vehicle appearance information linked with the VIN from the vehicle appearance information DB 2 can be omitted from the next time.

According to the configuration of the present embodiment, when a vehicle appearance information request signal is received, a VIN matching the search criteria indicated by the received vehicle appearance information request signal is searched for and vehicle appearance information linked with the VIN is retrieved. However, the present disclosure is not limited to the configuration as above. For example, it may be configured in such a manner that vehicle appearance information linked with a VIN included in wide area vehicle data is retrieved from the vehicle appearance information DB 2 at a stage when the wide area vehicle data transmitted from any vehicle-mounted device 1 is acquired. When configured in such a manner, the vehicle appearance information can be returned faster in response to reception of the vehicle appearance information request signal.

(Summary of the Present Embodiment)

According to the configuration as above, each vehicle-mounted device 1 broadcasts vehicle data made up of vehicle information of the own vehicle to other nearby vehicle-mounted devices 1 through a vehicle-to-vehicle communication, and uploads wide area vehicle data generated by appending the VIN assigned to the own vehicle to the vehicle data to the center 3.

When the wide area vehicle data transmitted from each vehicle-mounted device 1 is received at the end of the center 3, the vehicle information and the VIN both included in the received data are linked with each other and saved in the DB 33 at the center end.

When vehicle appearance information for any different vehicle is necessary, the vehicle-mounted device 1 transmits a signal including a generation time and location information included in different vehicle information received from the vehicle in question through a vehicle-to-vehicle communication to the center 3 as a vehicle appearance information request signal.

When the vehicle appearance information request signal is received at the end of the center 3, the DB 33 at the center end is searched through with the search criteria, namely the generation time and the location information included in the received vehicle appearance information request signal, to specify a VIN assigned to a vehicle matching the search criteria. Vehicle appearance information linked with the specified VIN is retrieved from the vehicle appearance information DB 2 and returned to the vehicle-mounted device 1.

Hence, the vehicle-mounted device 1 becomes capable of acquiring vehicle appearance information of any different vehicle as an information transmitter from information acquired through a vehicle-to-vehicle communication. In a case where the driver needs to be notified of the presence of the vehicle in question, the driver is notified of the presence of the vehicle in question and also what the vehicle in question looks like in vehicle appearance. Herein, "a case where the driver needs to be notified of the presence of the vehicle in question", is a case where a vehicle having a likelihood of an accidental contact with the own vehicle as high as or higher than the predetermined threshold value is present. That is, the driver can be notified of information on a vehicle to which the driver has to pay attention not only by a location relation with respect to the own vehicle, but also by the vehicle appearance information in the form of a display on the display 16 and a sound outputted from the speaker 17.

When configured as above, the driver can recognize what an attention requiring vehicle looks like by looking a display image on the display 16 or hearing a message outputted from the speaker 17.

When the driver visually confirms a vehicle considered as the attention requiring vehicle, the driver can determine whether the vehicle the driver is visually confirming is really the attention requiring vehicle by comparing the vehicle appearance information, for example, displayed on the display 16 with a vehicle appearance of the vehicle the driver is actually seeing. That is, according to the configuration as above, a correspondence between a different vehicle the driver is visually confirming and the attention requiring vehicle can be found readily.

According to the configuration of the present embodiment, the driver is notified of not only a size but also a body color of the attention requiring vehicle. Hence, the driver can determine a correspondence relation between a vehicle the driver is actually seeing and the attention requiring vehicle according to the body colors of the two vehicles. In particular, a size of a vehicle seen from the driver readily varies with a distance between the vehicle in question and the own vehicle (that is, sense of perspective). In contrast, the body color does not vary with a distance. Hence, even when the two vehicles are distant from each other, the driver notified of the body color of the attention requiring vehicle can readily determine a correspondence relation between the vehicle the driver is actually seeing and the attention requiring vehicle.

According to the configuration of the embodiment above, besides a size and a color of a vehicle, a body type can be notified to the driver as the vehicle information. Hence, even when vehicles of similar colors are coming in a row, each vehicle can be distinguished from the others by a body type.

According to the configuration of the embodiment above, three items of information including a body type, a color, and a size are notified to the driver. Two or more vehicles may have overlapping features in the respective items of information. However, a likelihood that vehicles all having same features in all the three items of information are coming in a group is relatively low. Hence, the driver notified with the three items of information can readily find a correspondence.

FIG. 8 is a view used to describe an example of a concrete scene where an effect of the present embodiment is more significant. FIG. 8 shows a scene where the vehicle Mx is nearing an intersection 5 and the vehicle My and the following vehicle Mz are going to enter the intersection 5 in a direction different from a road the vehicle Mx is traveling. A road the vehicles My and Mz are traveling is a narrow street or the like that is narrow relative to the road the vehicle Mx is travelling. The vehicles My and Mz are hidden behind a building Bld and cannot be visually confirmed directly by a driver of the vehicle Mx.

In such a circumstance, the warning processing portion F8 of the vehicle Mx warns the driver of the vehicle Mx to pay attention to the vehicles Mz and My by displaying locations of the vehicles My and Mz by using icon images resembling vehicle appearance information on the display 16. The driver thus becomes aware of not only a mere situation that the vehicles My and Mz are coming out from the narrow street connected to the intersection, but also what the vehicles My and Mz look like in vehicle appearance from display configurations (color, size, shape) of the icon images displayed on the display 16.

Hence, when the driver of the vehicle Mx at a distance from the intersection 5 visually confirms that the vehicle My is coming out, the driver does not erroneously recognize the visually confirmed vehicle as the vehicle Mz and makes a driving operation in preparation for the vehicle Mz coming out in a row.

While the above has described one embodiment by way of example, it should be appreciated that embodiments are not limited to the embodiment described above and various modifications including examples as follows can be made.

(First Modification)

According to the configuration of the embodiment above, the vehicle appearance information request portion F6 transmits a signal including time information and present location information included in different vehicle information received from a requested vehicle through a vehicle-to-vehicle communication as a vehicle appearance information request signal, while a VIN matching the search criteria, namely a generation time and location information indicated by the received vehicle appearance information request signal, is searched for at the end of the center 3. However, the present disclosure is not limited to the configuration described above.

For example, it may be configured in such a manner that the vehicle appearance information request portion F6 transmits a signal including time information included in different vehicle information received from the requested vehicle through a vehicle-to-vehicle communication and a vehicle ID identifying a transmitter of the vehicle information as a vehicle appearance information request signal to the center 3. In such a case, a generation time and the vehicle ID indicated by the received vehicle appearance information request signal are used as the search criteria, and a VIN linked with a combination of a generation time and a vehicle ID matching the search criteria is searched for at the end of the center 3. When a VIN matching the search criteria is found, vehicle appearance information linked with the found VIN is retrieved from the vehicle appearance information DB 2, and the retrieved vehicle appearance information is returned to a vehicle-mounted device 1 as a transmitter of the vehicle appearance information request signal.

Even when the configuration is modified as above, an effect same as the effect of the embodiment above can be obtained. It goes without saying that three items, namely a generation time, location information, and a vehicle ID, may be used as the search criteria, or location information and a vehicle ID may be used as the search criteria. Further, items included in vehicle information exchanged through a vehicle-to-vehicle communication, such as acceleration and a vehicle speed, may be used as the search criteria.

The above configuration has been described on an assumption that a vehicle ID is assigned dynamically. In a case where a vehicle ID assigned to a vehicle is invariable with time (that is, fixed), the vehicle ID alone may be used as the search criteria.

(Second Modification)

In a case where each vehicle-mounted device 1 is capable of acquiring route information, which is information indicating a scheduled route the own vehicle is to travel, the vehicle-mounted device 1 may transmit wide area vehicle data including the route information to the center 3. The route information may be route information set in a navigation device. That is, in a case where a scheduled route is set in the navigation device, the vehicle-mounted device 1 may acquire the route information from the navigation device.

In a case where the own vehicle includes an autonomous driving ECU (Electronic Control Unit), which is an ECU performing control processing for autonomous driving, the route information may be acquired from the autonomous driving ECU when the autonomous driving ECU is performing the control processing for autonomous driving.

In such a modified configuration, the vehicle-mounted device 1 acquires route information of a predetermined vehicle from the center 3. For example, the vehicle-mounted device 1 acquires route information of a vehicle determined by the warning determination portion F5 as having a likelihood of an accidental contact with the own vehicle, in other words, a vehicle determined that a movement trajectory estimated from a traveling direction and a present location crosses a movement trajectory of the own vehicle.

The warning determination portion F5 uses the route information acquired from the center 3 as a material for a determination on a likelihood of an accidental contact. For example, even in a case where a likelihood of an accidental contact is as high as or higher than a predetermined threshold value according to location information and moving directions of the own vehicle and a different vehicle at a present time, a likelihood of an accidental contact may decrease to substantially 0 when a right or left turn is taken in a real circumstance. More specifically, a different vehicle may change a course by taking a right or left turn at one intersection before an intersection where an accidental contact between the own vehicle and the vehicle in question is anticipated. In such a case, traffic lines of the both vehicles do not cross each other and a likelihood of an accidental contact decreases in an actual circumstance. That is, in a case where a different vehicle traveling on a scheduled route is guided to change a course by taking a right or left turn at one intersection before an intersection where an accidental contact between the own vehicle and the vehicle in question is anticipated, a likelihood of an accidental contact between the own vehicle and the vehicle in question decreases.

By acquiring information (route information) not included in information exchanged through a vehicle-to-vehicle communication from the center 3 in the manner as above, determination accuracy of the warning determination portion F5 can be increased. A possibility that the warning processing portion F8 performs warning processing unnecessarily can be reduced.

By configuring in such a manner that a vehicle appearance information request signal for a vehicle is transmitted when the warning determination portion F5 determines the presence of the vehicle in question as a vehicle requiring attention, a vehicle appearance information request signal is transmitted less frequently. Hence, not only can a processing load on respective portions be lowered, but also communication costs of the vehicle-mounted device 1 can be saved.

(Third Modification)

The above has described the configuration in which the driver is provided with vehicle appearance information of any different vehicle present near the own vehicle and determined as being a vehicle requiring attention by the warning determination portion F5 by way of example. However, the present disclosure is not limited to the configuration as above. The driver may be provided with vehicle appearance information of all the different vehicles present near the own vehicle and making a vehicle-to-vehicle communication with the own vehicle.

(Fourth Modification)

The above has described the configuration in which the driver is taught about a vehicle type, a size, and a color as vehicle appearance information of a vehicle. However, the present disclosure is not limited to the configuration as above. Any one of a vehicle type, a size, and a color may be taught to the driver. That is, at least one of a vehicle type, a size, or a color may be taught to the driver as the vehicle appearance information of a vehicle. The vehicle appearance information exchanged between the vehicle appearance information DB 2 and the center 3 and between the center 3 and the vehicle Mx may include at least a type of information to be taught to the driver.

What is claimed is:

1. A driving assistance system comprising:

a first vehicle-mounted device used in a first vehicle and furnished with a function of performing a vehicle-to-vehicle communication;

a plurality of second vehicle-mounted devices respectively used in a plurality of second vehicles, each of the plurality of second vehicle-mounted devices being furnished with a function of performing the vehicle-to-vehicle communication;

a center configured to perform a wide area communication individually with the first vehicle-mounted device or each of the plurality of second vehicle-mounted devices; and a vehicle appearance information storage portion storing a vehicle identification number assigned to each of the plurality of second vehicles and vehicle appearance information indicating a vehicle appearance of each of the plurality of second vehicles, the vehicle identification number being linked with the vehicle appearance of a same second vehicle, wherein each of the plurality of second vehicle-mounted devices includes:

a transmission processing portion broadcasting, through the vehicle-to-vehicle communication, vehicle information including various types of information indicating a traveling state of an own vehicle, the own vehicle being one of the plurality of second vehicles that use the plurality of second vehicle-mounted devices; and a transfer processing portion transmitting, to the center, wide area vehicle information that includes a vehicle identification number assigned to the own vehicle and specifying information of the own vehicle, the specifying information being a part or whole of the vehicle information transmitted from the transmission processing portion, the specifying information is information having a sufficiently low likelihood that contents of respective specifying information of the plurality of second vehicles overlap with one another, the center includes a storage portion that links the vehicle identification number with the specifying information included in the wide area vehicle information and stores the vehicle identification number and the specifying information, the wide area vehicle information is transmitted from each of the plurality of second vehicle-mounted devices and received by the center, the first vehicle-mounted device includes:

a different vehicle information acquisition portion acquiring the vehicle information broadcasted from each of the plurality of second vehicle-mounted devices through the vehicle-to-vehicle communication;

a notification processing portion notifying a driver in the first vehicle of information on a transmitter vehicle which is one of the plurality of second vehicles as a transmitter of the vehicle information acquired by the different vehicle information acquisition portion; and a vehicle appearance information request portion transmitting a vehicle appearance information request signal to the center, the vehicle appearance information request signal including the specifying information acquired from the vehicle information of the transmitter vehicle and requesting the center to transmit vehicle appearance information of the transmitter vehicle corresponding to the vehicle information, the center further includes:

a transmitter vehicle specifying portion specifying a vehicle identification number assigned to the transmitter vehicle upon receipt of the vehicle appearance information request signal transmitted from the first vehicle-mounted device, the transmitter vehicle specifying portion searching the storage portion of the center for the specifying information which matches with the specifying information included in the vehicle appearance information request signal; and a vehicle appearance information acquisition portion retrieving vehicle appearance information linked with the vehicle identification number specified by the transmitter vehicle specifying portion from the vehicle appearance information storage portion, the center transmits the vehicle appearance information retrieved by the vehicle appearance information acquisition portion of the center to the first vehicle-mounted device, the first vehicle-mounted device further includes a vehicle appearance information acquisition portion acquiring the vehicle appearance information transmitted from the center, and the notification processing portion notifies the driver in the first vehicle of a presence of the transmitter vehicle in a manner that the driver is able to recognize a vehicle appearance of the transmitter vehicle using the vehicle appearance information acquired by the vehicle appearance information acquisition portion of the first vehicle-mounted device.

2. The driving assistance system according to claim 1, wherein the vehicle information includes at least identification information identifying the transmitter vehicle of the vehicle information, time information indicating a time when the vehicle information is generated in the transmitter vehicle, and location information of the transmitter vehicle, and the specifying information includes at least the time information, and the specifying information further includes the location information or the identification information.

3. The driving assistance system according to claim 1, wherein the first vehicle-mounted device further includes:

a first vehicle information acquisition portion acquiring first vehicle information indicating a traveling state of the first vehicle; and a warning determination portion determining, based on the vehicle information received from one of the plurality of second vehicle-mounted devices and the first vehicle information acquired by the first vehicle information acquisition portion, whether to notify the driver in the first vehicle of the presence of the transmitter vehicle that has sent the vehicle information, and the notification processing portion notifies the driver in the first vehicle of the presence of the transmitter vehicle, which is one of the plurality of second vehicles and is determined by the warning determination portion that the presence needs to be notified, in a manner that the driver is able to recognize the vehicle appearance of the transmitter vehicle that is notified.

4. The driving assistance system according to claim 3, wherein, when the warning determination portion determines that the presence of the transmitter vehicle needs to be notified to the driver, the vehicle appearance information request portion transmits, to the center, the vehicle appearance information request signal corresponding to the transmitter vehicle.

5. The driving assistance system according to claim 3, wherein the first vehicle-mounted device includes a display, and the notification processing portion displays the vehicle appearance information of the transmitter vehicle that is notified on the display.

6. The driving assistance system according to claim 1, wherein the vehicle appearance information includes at least one of a body shape type, a body size, or a body base color of a vehicle.

7. A vehicle-mounted device comprising:

a wide area communication portion performing a wide area communication with a center disposed outside of an own vehicle;

a transmission processing portion broadcasting vehicle information including various types of information indicating a traveling state of the own vehicle through a vehicle-to-vehicle communication;

a transfer processing portion transmitting wide area vehicle information to the center, the wide area vehicle information including specifying information that is predetermined type of information and a vehicle identification number that is a number preliminarily assigned to the own vehicle, the specifying information and the vehicle identification number are a part of the vehicle information transmitted from the transmission processing portion;

a different vehicle information acquisition portion acquiring different vehicle information broadcasted from a different vehicle through the vehicle-to-vehicle communication;

a notification processing portion notifying a driver in the own vehicle of information on a transmitter vehicle that is the different vehicle in response to an acquisition of the vehicle information by the different vehicle information acquisition portion;

a vehicle appearance information request portion transmitting a vehicle appearance information request signal to the center, the vehicle appearance information request signal including specifying information included in the different vehicle information transmitted from the transmitter vehicle and requesting the center to provide vehicle appearance information indicating a vehicle appearance of the transmitter vehicle; and a vehicle appearance information acquisition portion acquiring the vehicle appearance information of the transmitter vehicle, the center transmitting the vehicle appearance information of the transmitter vehicle in response to the vehicle appearance information request signal transmitted from the vehicle appearance information request portion, wherein the notification processing portion notifies the driver in the own vehicle of a presence of the different vehicle in a manner that the driver is able to recognize the vehicle appearance information of the different vehicle.

* * * * *